US006382296B1

(12) United States Patent
Judkins

(10) Patent No.: US 6,382,296 B1
(45) Date of Patent: May 7, 2002

(54) HEADRAIL AND BRACKET SYSTEM FOR WINDOW COVERINGS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 09/816,276

(22) Filed: Mar. 23, 2001

(51) Int. Cl.[7] ..... E06B 9/30
(52) U.S. Cl. ..... 160/178.1 R; 160/902
(58) Field of Search ..... 160/178.1 R, 178.1 V, 160/173 R, 173 V, 168.1 R, 176.1 R, 902; 248/251, 254, 261, 262, 264

(56) References Cited

U.S. PATENT DOCUMENTS 4,949,926 A * 8/1990 Liu ..... 160/178.1 R X
5,060,710 A * 10/1991 Haarer ..... 160/902
5,186,426 A * 2/1993 Wada ..... 160/902 X
5,320,154 A 6/1994 Colson et al.
5,353,857 A 10/1994 Anderson
5,533,560 A * 7/1996 Morris ..... 160/178.1 R
6,186,457 B1 * 2/2001 Carter ..... 160/902 X

* cited by examiner

*Primary Examiner*—David M. Purol
(74) *Attorney, Agent, or Firm*—Buchanan Ingersoll, P.C.

(57) ABSTRACT

A headrail and bracket system for window coverings has a plurality of brackets that support the headrail. Each bracket is generally L-shaped having a top that extends over the headrail and a tab or front wall that engages that front wall of the headrail. The rear of the bracket engages the bottom of the headrail. A lever extends from the front wall toward the back wall and engages the top of the headrail or a tab extending from the top of the headrail. An actuator is movably connected to the rear wall of the bracket and is positioned to engage the lever and move the lever to release the headrail.

12 Claims, 3 Drawing Sheets

HEADRAIL AND BRACKET SYSTEM FOR WINDOW COVERINGS

FIELD OF INVENTION

The invention relates to a headrail for window coverings such as pleated shades, roman shades and venetian blinds and the brackets used to mount the headrail on a window frame.

BACKGROUND OF THE INVENTION

Headrails for window coverings generally are elongated metal structures having a front wall and a bottom with some headrails also having a rear wall parallel to the front wall. These headrails are mounted on the window frame with brackets that either attach to the ends of the headrail or to the walls of the headrail at selected intervals. One common type of bracket is an L-shaped structure having hooks at either end. An example of such a prior art bracket is shown in FIG. 1. That bracket has a rear wall R with a spring arm S extending from the rear wall. This arm can flex toward and away from the rear wall. A top T extend from the upper edge of the rear wall R. There is a hook one the outer edge of the top and a hook on the end of the spring S. The headrail H is seated in the hook on the spring and a lip on the front wall of the headrail fits into the hook on the top T. A headrail is installed on this prior art bracket by first placing the lip of the front wall on the hook on the top and there pivoting the headrail back towards the rear wall R until a rail on the bottom edge of the headrail catches within the hook on spring S. Typically there will be a notch in the top of the bracket into which the top edge of the rear wall of the headrail fits. This notch arrangement means that the headrail cannot move toward and away from the rear wall of the bracket. Should the width of the headrail be out of specifications the rear wall of the headrail must be flexed to fit within the notch. But, at the ends of the headrail and near the cradles the headrail may not flex. Therefore, the bracket cannot be placed at these locations even though those locations are the positions where the most support is needed. Another prior art bracket that is rarely used is C-shaped having a flat portion with hooks at either end that engage the rear wall and bottom of the headrail. A major problem with the C-shaped bracket as well as the bracket shown in FIG. 1 is that after the headrail has been mounted on the brackets the positions of the brackets are difficult to find when one desires to take down the blind. This problem is overcome in a similar bracket that has a lip on the front wall that turns outward rather than inward and the hook on the front extends over the lip. When this bracket is used the portion of the hook that extends over the front wall of the headrail is easily seen unless the hook has been painted to match the color of the headrail. But, if painting is done the cost of the bracket is higher and the installer must carry brackets in a variety of colors to match all of his headrails.

The art has also developed brackets with lock mechanisms that releasably engage the headrail. One such bracket was sold by Verosol USA in the 1980's and is illustrated in FIG. 2. This bracket had a rear wall R having a hook at the bottom and top portion T extending outward from the top edge of the wall rear. A spring lever S extended down from the top. The rear wall was configured as shown to have a pad portion through which a pair of mounting screws passed to attach the bracket to the wall. A sliding bar B with a hook fits through a slots in the rear wall on either side of the pad portion. The bar passes between the heads of the pair of screws and engages the spring S. The headrail H has a lip or rail along the rear edge of its bottom. To install the headrail the installer placed the rail on the hook and pivoted the headrail on the hook until the rear wall of the headrail passed over a bump on the spring to the position shown in FIG. 2. The spring pressed down on the rear wall of the headrail keeping the rail along the bottom edge of the headrail in the hook. To remove the headrail from the bracket the installer pushed the bar upward against the spring and lifted the headrail from the hook on the rear wall R of the bracket. This bracket had several problems and was not commercially successful. The bracket provided no support for the front of the headrail. Therefore, one pulling the lift cords extending from the headrail could dislodge the headrail from the bracket. The bracket could flex or rock about the mounting screws because both the top and the bottom edges of the rear wall R of the bracket were spaced away from the wall on which the bracket was mounted.

Large blinds require several brackets for installation. Typically, the installer attaches the brackets to the window frame and then attaches the headrail of the blind to the brackets. If the brackets have a locking mechanism the installer then activates the mechanism on each bracket to hold the blind in place. While one installer can himself install most blinds, many brackets are difficult to disengage from the headrail and thus require two installers to take the blind down. One person must hold the headrail on the brackets while the second person releases all the lock mechanisms and moves his ladder to reach the spaced apart brackets. The second person is needed because when all lock mechanisms are released the headrail may easily fall from the brackets. A second person is also required because the spring on the bracket, particularly the bracket shown in FIG. 1, is often stiff making it difficult to disengage the headrail from the hooks.

Another problem encountered with many brackets of the prior art is that they can only engage the headrail at certain locations. Should the installer be unable to attach the bracket to a window frame at any preselected position, he may simply not install it or must try to cut the headrail or bracket to attach the bracket at a different location.

Yet another problem with the brackets of the prior art is that a headrail can easily move transversely along a path parallel to the wall on which it is mounted. Such transverse movement may hinder installation and removal of the blind. In addition the blind could creep left or right over time as the blind is raised and lowered by the user.

Consequently, there is a need for a bracket and headrail system that is easy to install and allows the installer to place brackets at any location along the headrails. Such a system should enable a single installer to mount any large blind that he can lift into place. The brackets should securely hold the headrail and yet allow easy removal and replacement by a single installer.

SUMMARY OF THE INVENTION

A headrail and bracket system for window coverings has a plurality of brackets that support the headrail. Each bracket has a top having a front edge and a rear edge. A rear wall and a front wall extend from the top. The rear wall has a first portion attached to the rear edge of the top, a first transition position attached to the first portion, a second portion attached to the second portion and a third portion attached to the second transition portion, the first portion and the third portion lying in a common plane and the second portion being parallel to the common plane. When the bracket is installed the first and third portions are flush with the wall providing two spaced apart areas of wall contact. A lever extends from the front wall toward the back wall to a distal end. The lever has at least one tab extending from the lever in a direction away from the top. An actuator is movably connected to the rear wall and positioned to engage the lever and move the lever toward the top.

The headrail has a front wall having with a top and a bottom extending towards the rear wall of the bracket. A first tab is attached to the top portion of the front wall and forms a slot defined by the first tab and the top of the headrail. A bracket tab extends from the front wall of the bracket and is within the slot. A second tab extends from the top of the headrail and is engaged by the tab extending from the lever. The bottom of the headrail has a tab or rail engaged by the at least one hook extending from the rear wall of the bracket.

Description of the Preferred Embodiments

Figure 3:
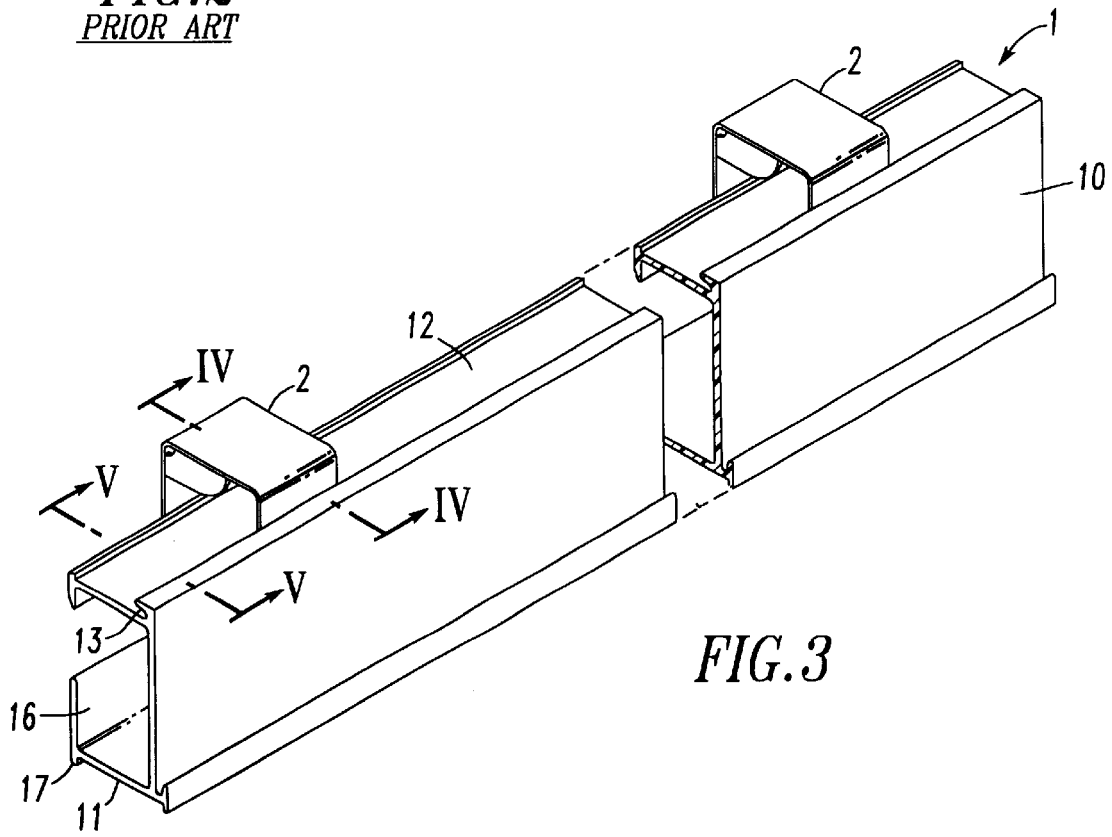
FIG. 3 is a perspective view of a present preferred embodiment of my headrail and bracket system.
Figure 4:
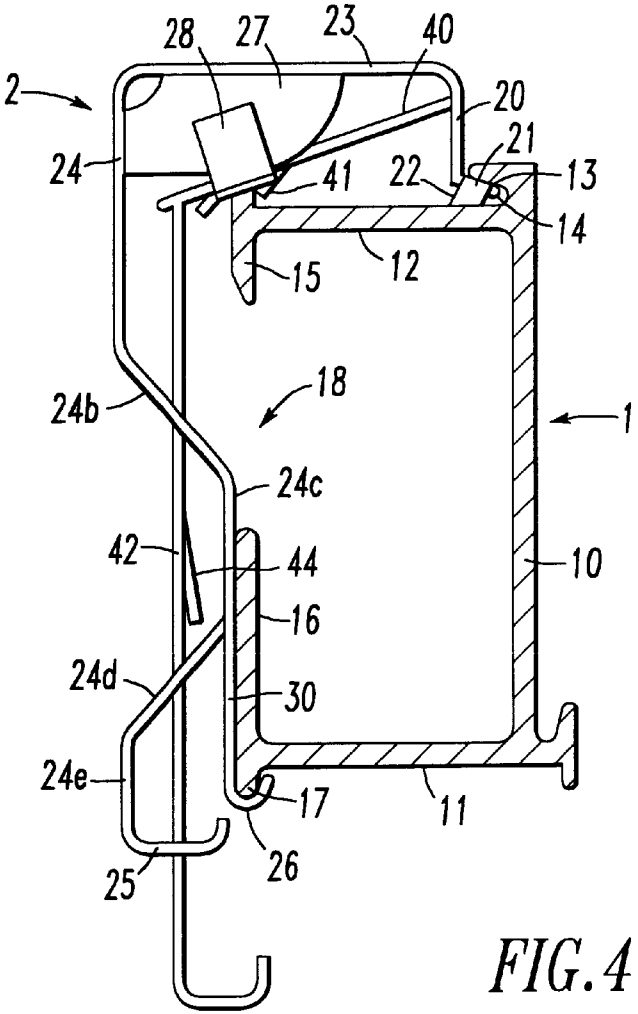
FIG. 4 is a sectional view taken along the line IV–IV in FIG. 3.

As shown in FIGS. 3 and 4, a headrail is held on a window frame by two or more spaced apart brackets 2. The headrail has a front wall 10, a bottom 11 extending from the bottom portion of the front wall and a top 12 extending from the top portion of the front wall. A tab or lip 13 extends over the top 12 to form a slot 14. A second tab or rail 15 extends upward from the opposite end of the top 12. If desired, tab 15 may also extend downward from the top. The bottom 11 extends from the lower portion of the front wall 10 until it reaches the rear wall 16 of the headrail. A tab or rail 17 extends down from the bottom 11 and is aligned with the rear wall. The gap 18 between the rear wall 16 and tab 15 provides access to the interior of the headrail.

Figure 1:
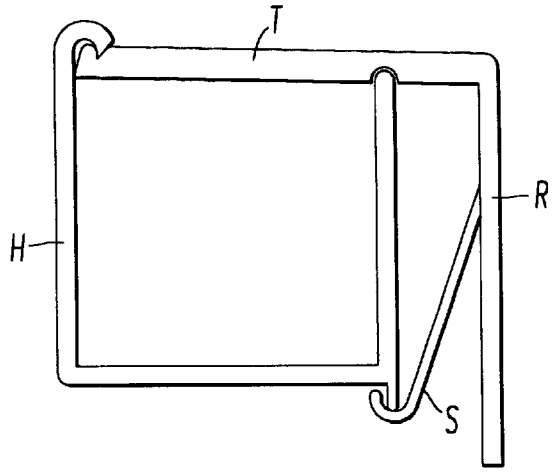
FIG. 1 PRIOR ART
FIG. 1 is an end view of a prior art bracket.
Figure 2:
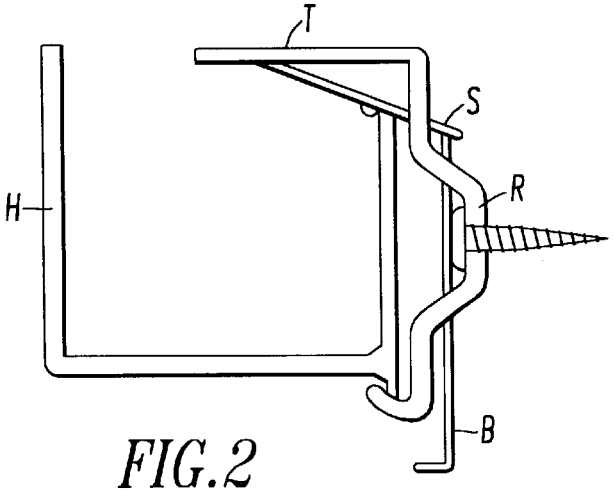
FIG. 2 PRIOR ART
FIG. 2 is an end view of another prior art bracket.
Figure 5:
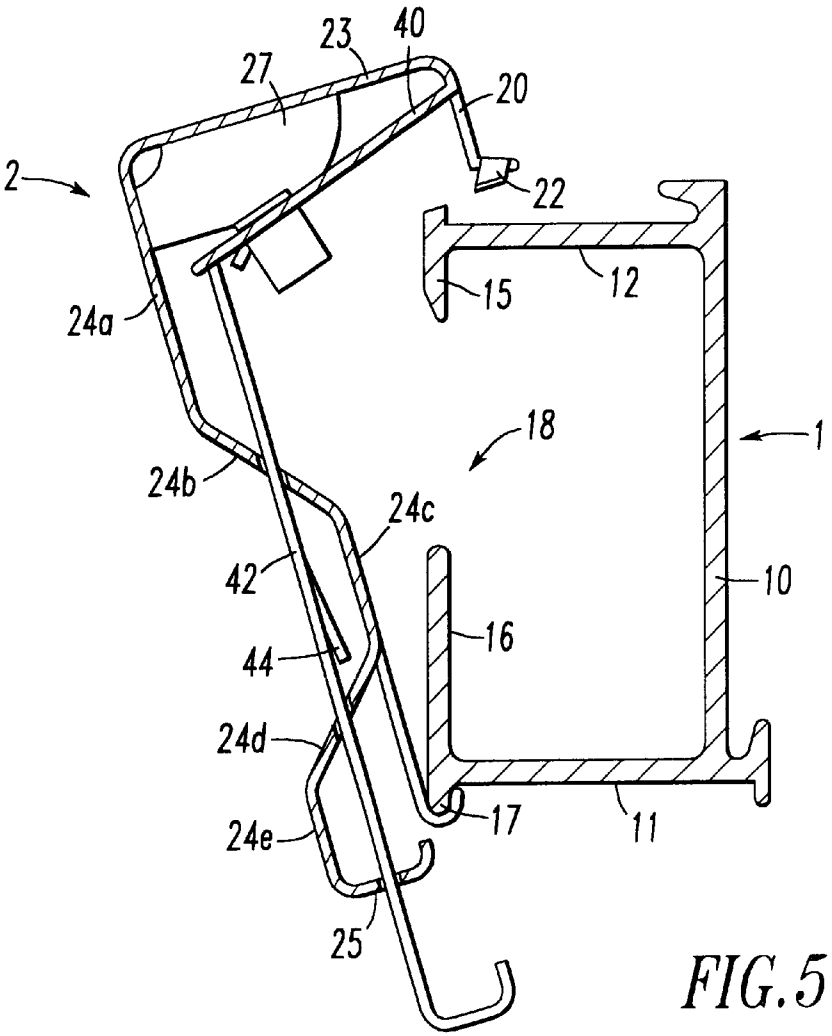
FIG. 5 is a sectional view similar to FIG. 4 taken along the line V–V in FIG. 3 showing the headrail positioned as it is being removed from the bracket.
Figure 6:
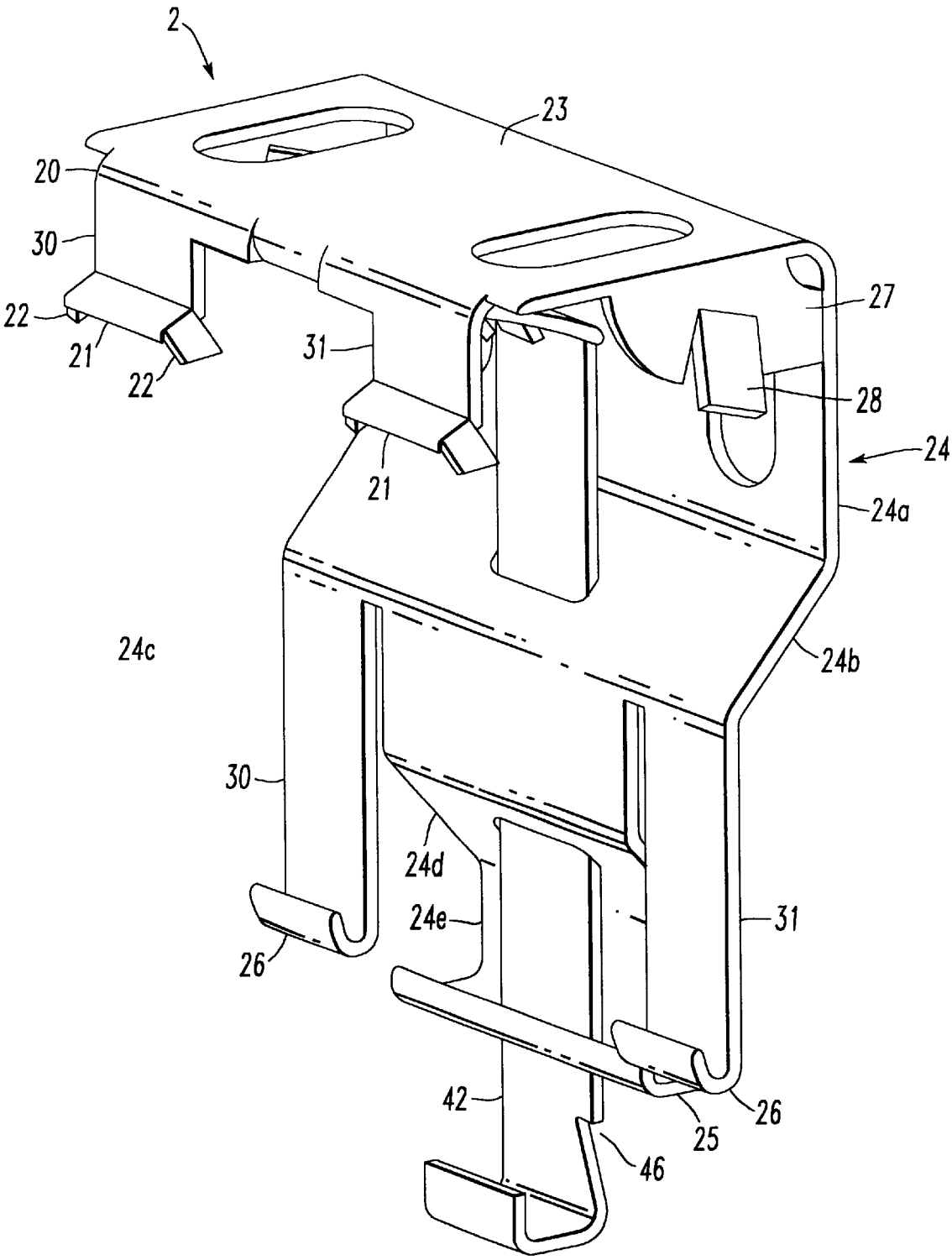
FIG. 6 is a perspective view of a present preferred bracket used in the system of FIGS. 3 through 5.

The bracket 2 has a front wall 20 having a hook or tab 21 that fits within slot 14 of the headrail. Preferably this hook or tab is inclined or beveled. I further prefer to attach at least one barb 22 on the front wall 20 of the bracket, which embeds itself into the top 12 of the headrail. This barb prevents transverse movement of the headrail after the headrail has been mounted on the bracket. As can be seen in FIG. 6, the front wall 20 may be configured to have two legs 30 and 31 that each carry a hook or tab 21 that fits within slot 14 of the headrail. Each leg has a pair of barbs 22. A bracket top 23 extends from the front wall 23 to the rear wall 24. The rear wall is configured to have a first portion 24*a* attached to the top 23, a second portion 24*c* in a plane parallel to the first portion but inward from the first portion. There is a first transition portion that connects the first portion 24*a* to the second portion 24*c*. A second transition portion 24*d* extends from the second portion 24*c* of the rear wall to the third portion 24*e* of the rear wall. Finally, a hook 25 is attached to the third portion 24*e*. The first and third portions 24*a* and 24*e* of the rear wall preferably lie in a common plane. When the bracket is installed the first and third portions are flush with the wall providing two spaced apart areas of wall contact. Consequently, the bracket will not rock like the prior art bracket shown in FIG. 2. The second portion 24*c* is preferably parallel to that common plane. Two second hooks 26 extend from the rear wall 24 at the junction of the second portion 24*c* and the second transition portion 24*d*. The hooks are sized to receive the tab or rail 17 of the headrail. I prefer to provide a brace 27 between the top of the bracket and the rear wall 24. I further prefer to attach at least one barb 28 to the brace 27. The barb can be sized and positioned to embed itself in tab 15 or the top 12 of the headrail. A lever 40 extends from the front wall 20 of the bracket toward the rear wall 24. The lever 40 has at least one tab 41 positioned to engage tab 15 of the headrail. The lever 40 is flexible and biased to press downward against the headrail. Slots 29 are provided in the top 23 and rear wall 24 so that the bracket can be attached to a window frame by screws passing through the slots. An actuator 42 extends through holes in the transition sections of the rear wall 24*b* and 24*d* to a point below the end of the lever 40 as shown in FIG. 2. A hook or tab 43 on the actuator engages the second transition portion 24*d* of the rear wall 24. To release the headrail one pushes the actuator 42 upward causing lever 40 to flex upward away from the headrail. This allows the top of the headrail to be pulled forward releasing the tab 21 from slot 14. Then the headrail can be pivoted away from the rear wall of the bracket as shown in FIG. 5. Once in that position the headrail can be lifted from the bracket 2. A tab 44 on the activator 40 holds the actuator on the rear wall of the bracket. A notch 46 on the activator 40 is provided to lock the actuator in an open position.

The bracket of the present invention can securely hold the headrail when the actuator is positioned as shown in FIG. 4. When the actuator is pushed to the position of FIG. 5 the headrail still may rest within the bracket. However, in that circumstance one can easily pivot the headrail 1 away from the brackets 2. Consequently, for blinds held by three or more brackets one person can first unlock the headrail by moving the actuators on all brackets. Then he can pivot the headrail from the brackets. From the position of the actuator it is readily apparent whether or not the headrail is locked. Typically, the headrail will be a metal extrusion and the bracket will be a metal stamping. I prefer to make the bracket and actuator from spring steel. Then the front wall 20 of the bracket as well as the actuator can flex toward and away from the rear wall 24.

Although I have shown and described certain present preferred embodiments of my headrail and bracket system, it should be distinctly understood that the invention is not limited thereto but may be variously embodied within the scope of the following claims.

I claim:

1. A bracket for a headrail comprising:

a top having a front edge and a rear edge;

a rear wall extending from the rear edge of the top, the reartwall having a first portion attached to the rear edge of the top, a first transition position attached to the first portion, a second portion attached to the second portion and a third portion attached to the second transition portion, the first portion and the third portion lying in a common plane;

a front wall extending from the first edge of the top to a distal end;

a tab extending from the front wall;

a lever extending from the front wall toward the back wall to a distal end, the lever having at least one tab extending from the lever in a direction away from the top;

an actuator movably connected to the rear wall and positioned to engage the lever and move the lever toward the top; and at least one hook extending from the rear wall.

2. The bracket of claim 1 also comprising at least one barb attached to the front wall.

3. The bracket of claim 1 also comprising a brace connected between the top and the rear wall.

4. The bracket of claim 1 also comprising at least one barb attached to the brace.

5. The bracket of claim 1 wherein the front wall is made of a material that enables the front wall to flex toward and away from the rear wall.

6. The bracket of claim 5 wherein the material is spring steel.

7. The bracket of claim 1 wherein the second portion is substantially parallel to the common plane.

8. A headrail and bracket system for window coverings comprising:

a. a plurality of brackets, each bracket comprised of a top having a front edge and a rear edge;

a rear wall extending from the rear edge of the top, the rear wall having a first portion attached to the rear edge of the top, a first transition position attached to the first portion, a second portion attached to the second portion and a third portion attached to the second transition portion, the first portion and the third portion lying in a common plane;

a front wall extending from the first edge of the top to a distal end;

a tab extending from the front wall;

a lever extending from the front wall toward the back wall to a distal end the lever having at least one tab extending from the lever in a direction away from the top;

an actuator movably connected to the rear wall and positioned to engage the lever and move the lever toward the top; and at least one hook extending from the rear wall; and b. a headrail comprised of:

a front wall having a top portion and a bottom portion;

a top extending from the top portion of the front wall towards the rear wall of the bracket; and a first tab attached to the top portion of the front wall and forming a slot defined by the first tab and the top of the headrail such that the tab extending from the front wall of the bracket is within the slot;

a second tab extending from the top of the headrail and engaged by the at least one tab extending from the lever; and a bottom extending from the bottom portion of the front wall toward the rear wall of the bracket, the bottom having a tab engaged by the at least one hook extending from the rear wall of the bracket.

9. The headrail and bracket system of claim 8 also comprising at least one barb attached to the front wall of the bracket and embedded into the top of the headrail.

10. The headrail and bracket system of claim 8 also comprising at least one brace connected between the top of the bracket and the rear wall of the bracket.

11. The headrail and bracket system of claim 10 also comprising at least one barb attached to the brace and embedded in of at least one of the top of the headrail and the second tab of the headrail.

12. The headrail and bracket system of claim 10 wherein the bracket is spring steel.

* * * * *

UNITED STATES PATENT AND TRADEMARK OFFICE

CERTIFICATE OF CORRECTION

PATENT NO. : 6,382,296 B1
DATED : May 7, 2002
INVENTOR(S) : Ren Judkins

It is certified that error appears in the above-identified patent and that said Letters Patent is hereby corrected as shown below:

Column 4,
Line 55, change "reartwall" to -- rear wall --.

Signed and Sealed this

Sixteenth Day of July, 2002

*Attest:*

*Attesting Officer*

JAMES E. ROGAN
*Director of the United States Patent and Trademark Office*